United States Patent [19]

Geringer et al.

[11] Patent Number: 4,634,155

[45] Date of Patent: Jan. 6, 1987

[54] POWER ACTUATED DOOR LOCKING AND MONITORING ASSEMBLY

[76] Inventors: Arthur V. Geringer, 5424 Geyser, Tarzana, Calif. 91356; Richard G. Geringer, 28834 Barragan St.; David A. Geringer, 5382 Cheseboro Rd., both of Agoura, Calif. 90301

[21] Appl. No.: 528,874

[22] Filed: Sep. 1, 1983

[51] Int. Cl.[4] ..... E05C 1/06

[52] U.S. Cl. ..... 292/144; 70/281; 70/432; 292/181

[58] Field of Search ..... 292/144, 181, 177, 153, 292/144; 70/432, 281

[56] References Cited

U.S. PATENT DOCUMENTS

| | | | |
|---|---|---|---|
| 1,524,005 | 1/1925 | Dodge | 292/177 X |
| 2,339,170 | 1/1944 | Jacobs | 70/432 |
| 3,126,218 | 3/1964 | Andrews | 70/432 |
| 3,151,698 | 10/1964 | Pollock | 70/280 |
| 3,455,591 | 7/1969 | Powers | 292/335 |
| 3,576,119 | 4/1971 | Harris | 292/144 X |
| 3,758,142 | 9/1973 | Gartner | 292/341.16 X |
| 3,794,366 | 2/1974 | Graham | 292/144 |
| 4,021,065 | 5/1977 | Geringer | 292/144 |
| 4,099,752 | 7/1978 | Geringer | 292/144 |
| 4,268,075 | 5/1981 | Allenbaugh | 292/167 |

FOREIGN PATENT DOCUMENTS

| | | | |
|---|---|---|---|
| 90 | of 1912 | United Kingdom | 292/144 |
| 1355381 | 6/1974 | United Kingdom | 292/144 |

*Primary Examiner*—Gary L. Smith
*Assistant Examiner*—Lloyd A. Gall
*Attorney, Agent, or Firm*—John J. Posta, Jr.

[57] ABSTRACT

An improved door locking and monitoring assembly is provided which is power activated. The assembly comprises a housing disposable in a door frame and defining a passageway which has a bolt slidably disposed therein and lockset means in the door member. A lever is pivoted in the housing. The lever is L-shaped, with a spring biased vertical arm below it. The rear of the latter is urgeable upwardly by a ball to pivot the lever and move the bolt forward into the locked position. The ball is urgeable upwardly by a solenoid actuated plunger. The biased L-shaped arm has the arms thereof pivoted allowing relative angular movement. An extension on one of the arms is forced into an opening in the housing when the bolt is fully extended to lock-set the bolt. When the bolt moves into the locked position, a member on its rear end closes a powered switch to signal this condition. The assembly also can include a door position indicator device connected to or disposed within the housing and containing a switch normally closed by the door when in a closed position and which can provide a signal indicating the position of the door. The assembly assures full monitoring of a door fitted with the assembly so that it is known remotely whether the door is locked, unlocked, or dead-locked, and when the door is opened.

6 Claims, 4 Drawing Figures

POWER ACTUATED DOOR LOCKING AND MONITORING ASSEMBLY

BACKGROUND OF THE INVENTION

1. Field of the Invention

The present invention generally relates to locks and more particularly to an improved power activated door locking and monitoring assembly.

2. Prior Art

Various types of power activated door locking mechanisms are currently available. Many of these mechanisms are very bulky, complicated and expensive and few offer much versatility. In the event that the door locking mechanisms are overcome, there usually is no remote monitoring mechanism provided to determine if and when the door is in fact opened. It will be understood that under certain security circumstances it may be highly desireable to leave a door unlocked, but to be able to detect when the door is in fact opened and when it is closed.

Accordingly, there is a need for a simple, durable, compact, inexpensive and efficient power door locking system of an improved type which includes means for automatically monitoring the door locking function and also automatically monitoring the status of the door to which the system is attached; that is, to show whether it is opened or closed, closed and dead-locked, etc.

SUMMARY OF THE INVENTION

The improved door locking and monitoring assembly of the present invention satisfies all the foregoing needs. The assembly is substantially as set forth in the Abstract above. Thus, the assembly is compact and comprises a housing which fits neatly into a door frame. A face plate is connected to the housing.

The housing has a preferably horizontal passageway extending through it in which a bolt is slidably disposed. An L-shaped lever is pivoted in the housing with a first arm below the bolt and a second arm hinged to the first arm, which is spring restrained in a normal position perpendicular to the first arm and positioned upright behind the bolt. A solenoid activated drive mechanism urges a ball against the lower lever arm to pivot the lever and to cause the arm behind the bolt to drive the bolt through the passageway, out thereof into the locked position in a door. The upper portion of the second arm has an angeled extension adapted to extend into an opening in the housing when the bolt is fully extended, providing a lock-set function. The spring carried by the lever forces the extension into the opening. Removal of power from the solenoid causes the return spring on the bolt to urge the assembly back to its normal position with the camming surface of the extension urging such extension out of the opening. The rear end of the bolt bears an arm or tab which closes a switch in the passageway to signal the locked door condition.

The assembly also monitors the door to show whether it is open or closed, regardless of whether the bolt is in the locked or unlocked position. In some instances, as previously indicated, it may be desireable to leave the door unlocked but still monitor the door to determine if and when it opens. Further, the bolt can be intentionally severed or could break in the locked position so as to still indicate that the door is locked. However, the present assembly includes a switch in the door position indicator unit which shows when the door is opened or closed. This second safety feature further assures the integrity of the door locking assembly and increases its monitoring ability. Further features of the present invention are set forth in the following detailed description and accompanying drawings.

DRAWINGS

DETAILED DESCRIPTION

Figure 1:
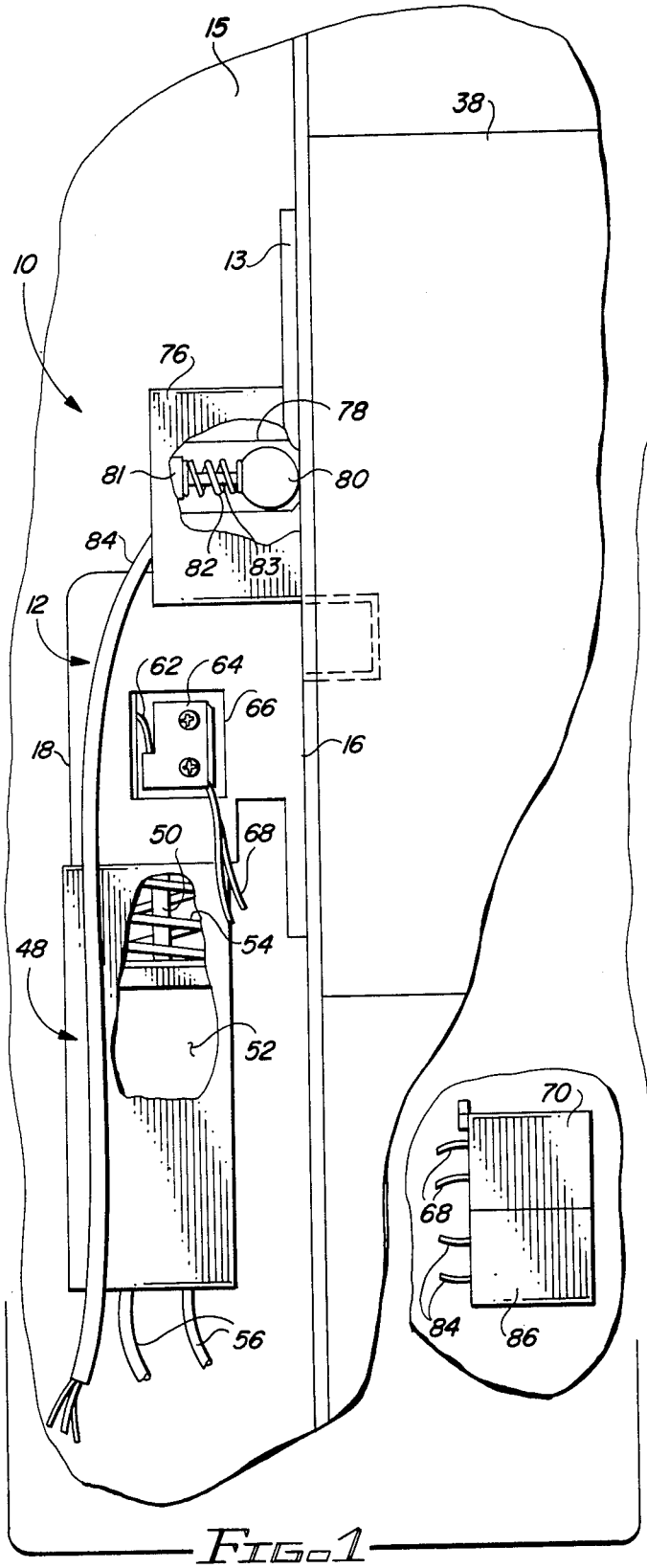
FIG. 1 is a schematic side elevation, partly broken away, of a preferred embodiment of the improved door locking and monitoring assembly of the present invention, showing the assembly mounted in place in a door frame.
Figure 2:
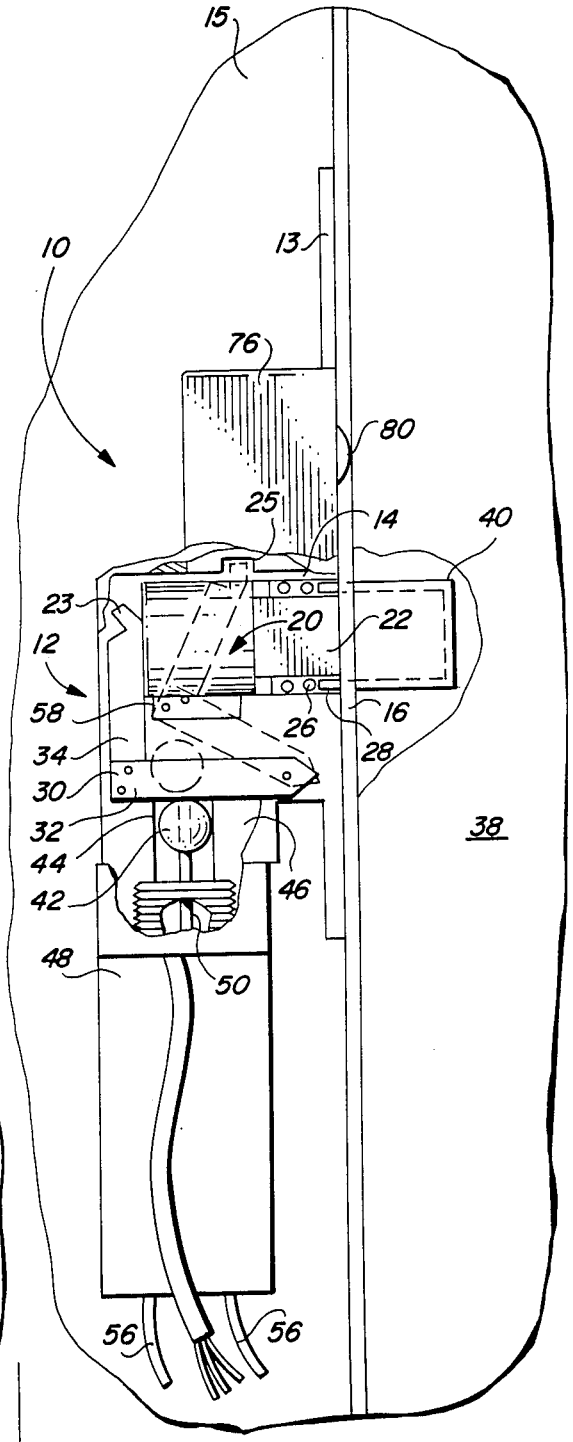
FIG. 2 is a schematic side elevation, partly broken away, of the assembly of FIG. 1, showing the monitoring and bolt operating functions of the assembly.
Figure 3:
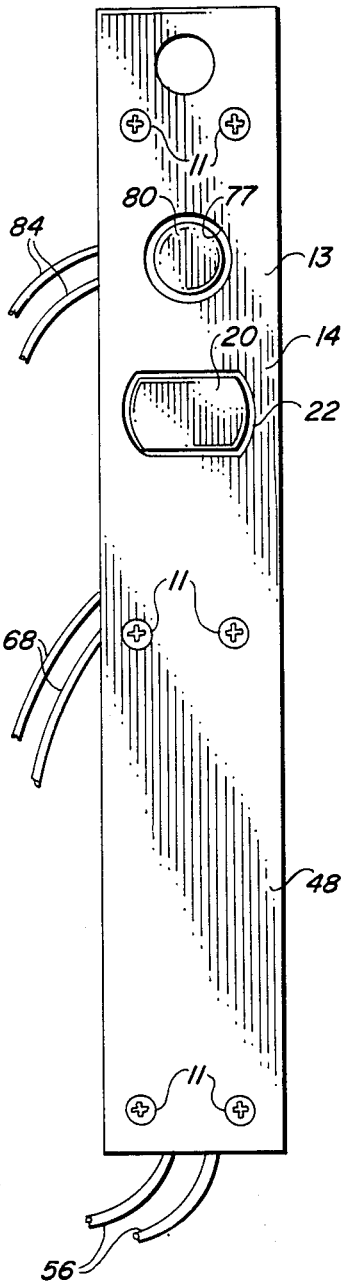
FIG. 3 is a schematic front elevation of the assembly of FIG. 1.
Figure 4:
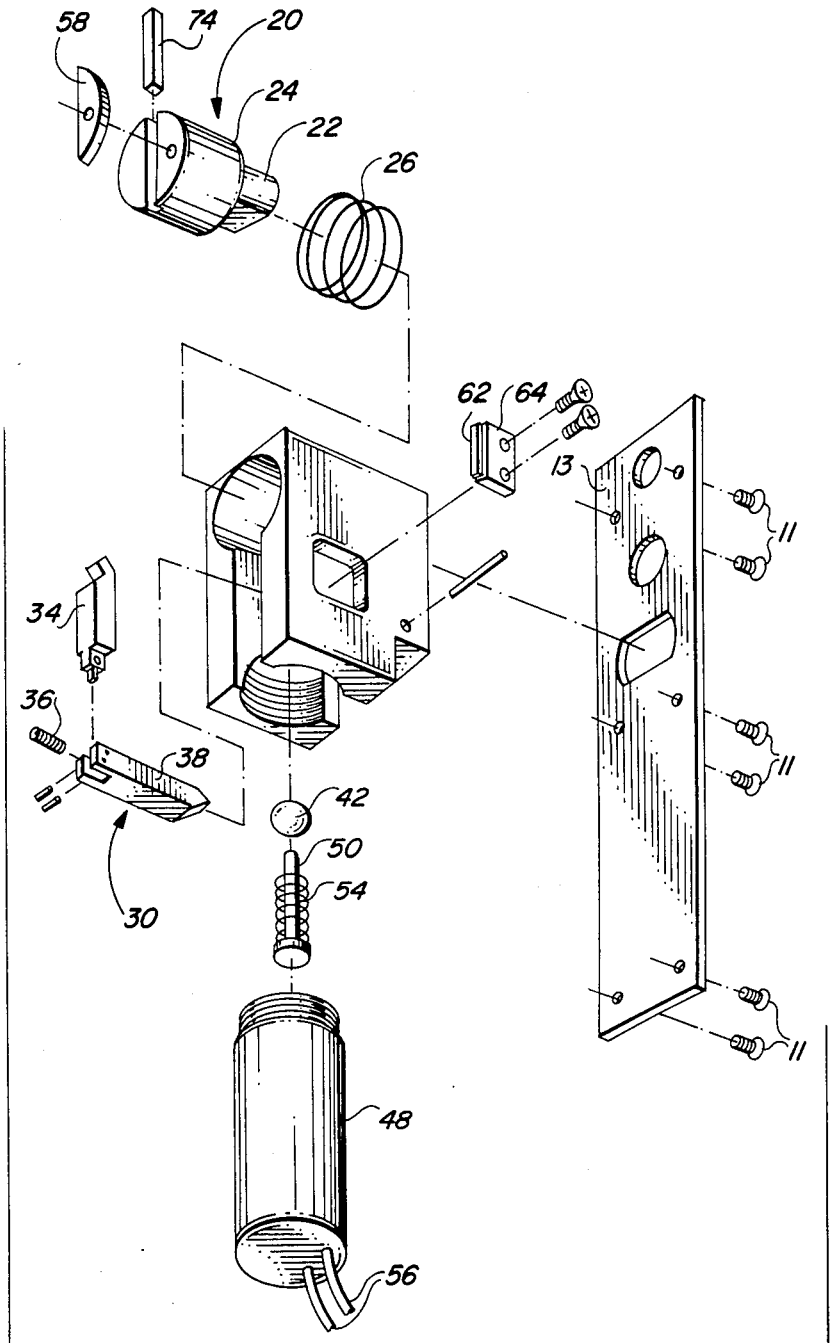
FIG. 4 is an exploded view of the several components of the assembly of FIG. 1.

Now referring more particularly to the accompanying drawings, FIGS. 1–4 schematically depict a preferred embodiment of the improved powered door locking and monitoring assembly of the present invention. Thus, assembly 10 is shown which comprises a housing 12 connected by screws 11 to a facing plate 13. Plate 13 is connected to a door frame 15. Housing 12 has a passageway 14 (FIG. 2) extending therethrough from the front end 16 to the back end 18 thereof. A bolt 20 is slidably disposed in passageway 14 and includes a front portion 22 of smaller dimensions than a rear portion 24 (FIGS. 2 and 4). If desired, a rear spring 26 may be positioned in passageway 14 between portion 22 and detent 28 (FIG. 2) to keep bolt 20 normally in the fully retracted unlocked position shown in FIG. 2. The detent 28 provided in the front of passageway 14 along with spring 26 also acts as a positive stop; that is, an assembly against which portion 24 can abut to limit the forward movement of bolt 20.

Bolt 20 is urged into the locked position, (shown in dotted outline in FIG. 2), by the operation of lever 30. Lever 30 includes a lower horizontal arm 32 disposed below bolt 20 and pivoted at its front end in housing 12, and a vertical arm 34 pivotably secured thereto and extending upwardly therefrom behind bolt 20. Arm 32 has a cavity (not shown) in which a spring 36 (FIG. 4) is disposed to releaseably hold arm 34 perpendicular to arm 32 and cause it to resist movement of arm 34 from the perpendicular position. Arm 34 also has an extension 23 adapted to move into a recess 25 in housing 12 to provide a deadlock when the bolt 20 is fully extended.

Means are provided in assembly 10 for remotely power activating lever 30 to lock door 38 by forcing bolt 20 into recess 40 in door 38 and extension 23 into recess 25. This is accomplished by a ball 42 resting against the underside of arm 32 in slot 44 in housing 12, and supported on the top 46 of a vertically casting 48 threadably received in the lower end of housing 12. Casting 48 includes a plunger 50 resting on and responsive to a solenoid 52, plunger 50 being disposed within an optional return spring 54 in casting 48. Operation of solenoid 52, as through electrical leads 56, causes plunger 50 to move upward, forcing ball 42 against arm 32, in turn causing lever 30 to pivot to the position shown in dotted outline in FIG. 2, thus causing arm 34 to force bolt 20 fully forward into the deadlocked position in recess 40 in door 38 and allow extension 23 to move into locked position in recess 25 in door housing 12. During such forward passage of bolt 20, the rear end thereof which bears a removable depending arm or tab 58 secured thereto by screw 60, presses tab 58 against spring arm 62 of switch 64 secured to the side of housing 12 in an opening 66 therein. Thus, arm 62 is moved into the closed switch position by tab 58, so as to remotely signal the bolt locking of door 38 through leads 68 connected to switch 64 and to a remote signal means 70, such as a bell, light, etc.

Bolt 20 may also have a rear slot 72 (FIG. 4) in which a wear plate 74 of nylon, polytetrofluoroethylene, brass, etc. can be secured and which is contacted by arm 34.

Assembly 10 also includes a door position sensing unit 76 which is connected to face plate 13. Unit 76 has a passageway 78 adapted to movably retain ball 80, which is biased outwardly by spring 82. Switch 81 has a plunger 83 which contacts ball 80, and generates a signal in response to the position of ball 80. The opening 77 in face plate 13 is smaller than the diameter of passageway 78 so as to keep ball 80 in the passageway 78. When door 38 is open, ball 80 moves outwardly to abut opening 77, thereby opening switch 81. When door 38 is closed, ball 80 is wedged inwardly along passageway 78, forcing plunger 83 to close switch 81, sending a signal over leads 84 to signal means 86 that the door is closed.

Thus, assembly 10 has a second door monitoring safety feature. The open or closed condition of door 38 is monitored as well as the locked or unlocked condition of door 38, all by utilizing the single, efficient, compact assembly 10, as illustrated.

It will be understood that assembly 10 can be made in various forms and of any suitable material. Although housing 12 and door 38 preferably are of metal, such as steel, brass, aluminum or the like, as are lever 30 and springs 26 and 36, other suitable materials could be used. Bolt 20, however, should be of hardened material such as case hardened steel or the like. It will also be understood that the configuration of bolt 20 can be changed without materially affecting the invention. Spring 26 could be eliminated and another return means, such as one utilizing gravity, utilized in place thereof. Unit 76 could be an integral part of housing 12, as could casing 48, if desired. Plunger 50 could merely be a cylindrical rod without a broad base and/or return spring 54 could be eliminated. Moreover switch 64 could if desired, be arranged to signal when bolt 20 is retracted or extended and switch 80 could be arranged to signal only when door 38 is closed or open. Additionally, the signals could be given only when preselected combinations of the foregoing conditions exist.

Further modifications, changes, alterations and additions could be made in the improved remotely powered door locking and monitoring assembly of the present invention, its components and parameters. All such changes, modifications alterations and additions as are within the scope of the appended claims form part of the present invention.

What is claimed is:

1. An improved power activated door locking and monitoring assembly, said assembly comprising:

(a) a housing adapted to be disposed in a door frame and defining a passageway extending to the front thereof;

(b) a bolt slideably disposed in said passageway;

(c) a lever disposed below and to the rear of said bolt, wherein said lever comprises a first arm and a second arm pivotably connected to the rear end of said first arm and extending at substantially a right angle with respect thereof when in an at-rest position, and spring means interconnecting said first and second arms for releasably maintaining said arms perpendicular to each other when in an at-rest position, (d) biasing means normally retaining said bolt in the fully retracted unlocked position in said passageway, (e) power activator means connected to said housing which, when energized, pivot said lever into the rear of said bolt causing said second arm to rotate in a clockwise direction from said perpendicular position while advancing said bolt against the action of said biasing means to the positively locked position extending out of the front of said passageway;

(f) dead-lock means for maintaining said bolt in the extended position;

(g) said dead-lock means including an extension on said second arm and a recess in said housing adapted to receive said extension, wherein movement of the bolt to the positively locked position causes concurrent counter-clockwise rotation of said second arm from said perpendicular position past the perpendicular position and concurrent movement of the extension into the recess to provide a lockset function;

(h) bolt position and signaling means secured to said housing activated by said bolt; and (i) door position detecting and signaling means associated with said assembly.

2. The improved door locking and monitoring assembly of claim 1 wherein said passageway is about horizontal and wherein said bolt biasing means comprises a spring in said passageway.

3. The improved door locking and monitoring assembly of claim 1 wherein said passageway is about horizontal, wherein said activator means includes a casing containing a solenoid operated plunger, a ball disposed on the free end of said plunger in a channel in said housing immediately below said first lever arm, whereby upon energizing said solenoid, said plunger forces said ball upward against said first lever arm, thereby pivoting said lever and causing said second lever arm to drive said bolt forward into said locked position.

4. The improved door locking and monitoring assembly of claim 1 wherein said bolt position detecting and signaling means comprises a switch having a switch arm extending into said passageway, and wherein the rear end of said bolt includes a tab which contacts said switch arm to close said switch only when said bolt moves forward in said passageway into the locked position.

5. The improved door locking and monitoring assembly of claim 1 including an indicator unit which serves to indicate whether the door is open or closed.

6. The improved door locking and monitoring assembly of claim 1 wherein said dead-lock means comprises an extension on said second arm and a recess in said housing, wherein movement of the bolt to the positively locked position causes concurent movement of the extension into the recess, thereby providing a lock-set function.

* * * * *